US005831202A

United States Patent [19]

Rustick

[11] Patent Number: 5,831,202

[45] Date of Patent: Nov. 3, 1998

[54] MUZZLE ATTACHMENT FOR BARREL OF GAS-OPERATED WEAPON

[76] Inventor: Joseph M. Rustick, 3043 E. Cypress, Phoenix, Ariz. 85008

[21] Appl. No.: 822,939

[22] Filed: Mar. 21, 1997

[51] Int. Cl.[6] ..... F41A 5/26

[52] U.S. Cl. ..... 89/193; 89/14.3; 42/101

[58] Field of Search ..... 89/191.01, 191.02, 89/192, 193, 14.3, 179, 14.4; 42/100, 101

[56] References Cited

U.S. PATENT DOCUMENTS

| | | | |
|---|---|---|---|
| 618,743 | 1/1899 | Silverman | 89/193 |
| 678,969 | 7/1901 | McClean | 89/14.3 |
| 785,974 | 3/1905 | McClean | 89/14.3 |
| 816,591 | 4/1906 | McClean | 89/193 |
| 1,743,472 | 1/1930 | Meyer | 89/191.01 |
| 1,901,138 | 3/1933 | Barnes | 89/14.3 |
| 2,088,268 | 7/1937 | Lauf | 89/193 |
| 2,101,862 | 12/1937 | MacGregor | 89/191.01 |
| 2,330,210 | 9/1943 | Garand | 89/193 |
| 3,246,567 | 4/1966 | Miller | 89/191.02 |
| 3,675,534 | 7/1972 | Beretta | 42/100 |
| 3,688,641 | 9/1972 | Curtis et al. | 89/191.01 |
| 4,406,078 | 9/1983 | De Blieck | 89/14.3 |

FOREIGN PATENT DOCUMENTS

| | | | |
|---|---|---|---|
| 115901 | 2/1946 | Sweden | 89/191.01 |

*Primary Examiner*—Stephen M. Johnson
*Attorney, Agent, or Firm*—Joseph H. Roediger

[57] ABSTRACT

A modified barrel for an automatic weapon having a muzzle attachment including a gas expansion chamber to permit use of a short barrel while delivering the normal pressure to the gas drive mechanism. The attachment delivers the gas pressure via a conduit from the chamber to an exit port coupled to the gas drive mechanism of the weapon.

8 Claims, 2 Drawing Sheets

12
14
16
18
20
21
22
25
26
3
4

MUZZLE ATTACHMENT FOR BARREL OF GAS-OPERATED WEAPON

BACKGROUND OF THE INVENTION

This invention relates to a muzzle attachment containing a gas expansion chamber for use with a gas-operated automatic weapon. The gas expansion chamber modifies the characteristics of the gas pressure buildup occurring in the barrel to permit the use of a barrel of reduced length.

The use of a gas-operated mechanism to automate all or a portion of the firing sequence of weapons is standard practice. The mechanism is driven by force translating means responsive to the change in gas pressure occurring in the barrel of the weapon upon the firing of a round. The amount of gas generated by a round is determined by the cartridge load and the caliber thereof. The characteristics of the gas pressure buildup taking place within the bore of the barrel are primarily determined by the volume of the bore. Since weapon caliber determines bore diameter, the length of the barrel is a major factor in determining the magnitude of the pressure buildup and the amount of force applied to the energy translating mechanism.

The energy translating mechanism typically includes a mechanical linkage designed to eject a spent round and load a fresh cartridge at a predetermined rate. The mechanism is operative at this rate when the force applied to the mechanical linkage is within a designed-for range. Should the force applied increase significantly, the speed at which the mechanical linkage operates increases as well. The speed increase can cause a potentially serious problem. The force generated due to the gas expansion can increase to the point where damage to the weapon takes place, or the rate of firing can continue to increase at an uncontrollable rate of firing.

Due to the interaction of the different mechanisms of an automatic weapon, the alteration or redesign of a part of the weapon is an impractical task leading to frequently unanticipated consequences. A primary target for redesign is the barrel length since it has the potential of increasing the ease of handling, operation and transportation of the weapon. In certain applications where weapon concealment is important, a reduction in barrel length is significant. However, the reduction in barrel length by any significant amount has been heretofore difficult to provide without incurring the above-noted problem. Heretofore, a redesign of the gas drive system is recommended in order to provide reliable and safe operation of an automatic weapon carrying a redesigned or shortened barrel. This type of undertaking is comparable in scope to the design of a new weapon and may result in an undesirable compromise of weapon performance standards.

The present invention has as its primary objective the provision of an attachment for affixation to the end of the barrel of an automatic weapon to provide compensation for a reduction in barrel length and deliver the appropriate force to the gas drive mechanism. This result is obtained without requiring extensive redesign of other portions of the weapon and without degrading any of the performance standards. The invention can provide reliable operation with a one-half length barrel for an automatic weapon without significantly changing the handling and performance of the weapon. Furthermore, a redesign of the mechanical linkage of the gas drive mechanism is not required to maintain reliable performance. Thus, the advantages of an automatic weapon having a shortened barrel can be obtained without a redesign of the receiver of the weapon and the substantial expenditures involved therewith.

SUMMARY OF THE INVENTION

The present invention is directed to a modified barrel for a gas-operated automatic weapon of the type utilizing the expansion of gas in the barrel to actuate a gas drive mechanism. The modified barrel contains a bore having a longitudinal axis extending therethrough with a free or distal end which receives a muzzle attachment. The proximal end of the barrel is affixed to the receiver of the automatic weapon in the normal fashion.

The muzzle assembly attached to the distal end of the barrel includes an attachment housing that has a central passage extending between opposing ends. The central passage is aligned with the longitudinal axis of the bore when the housing is affixed to the distal end of the barrel. An expansion chamber is located within the housing and communicates with the central passage. A gas conduit is included in the housing and extends between the expansion chamber and an external port. The external port is located in the housing in an area which facilitates connection to the mechanical linkage of the gas drive mechanism that is a standard feature of the weapon.

The expansion chamber contained in the housing has the central passage extending therethrough so that the round when fired passes out of the bore of the barrel through the attachment into a subsequent device such as a silencer or suppressor. The gas generated within the bore by the firing of the round is at its pressure maximum at the time of firing. The bore pressure decreases as the round exits the barrel and when the gas encounters the expansion chamber it undergoes a significant drop in pressure. This drop in pressure results in a reduced force being transmitted to the gas drive mechanism via the gas conduit. The goal is to provide a force to the gas drive mechanism that is within its normal operating range. This is achieved by the use of the expansion chamber providing a drop in pressure equivalent to that normally experienced by this weapon having a standard length barrel.

The modified barrel also includes means for attaching the first end of the housing to the distal end of the barrel in a manner which provides a sealing engagement between the parts. The attachment means is readily provided by providing a recess in the attachment to receive the distal end of the barrel and forming transverse receiving holes through the housing and the adjacent portion of the barrel. Engaging pins are inserted into the receiving holes to provide a secure fit between parts. In addition, the opposing end of the housing can be provided with means for removable receiving a second attachment device such as a suppressor of conventional design.

Further features and advantages of the invention will become more readily apparent from the following detailed description of a preferred embodiment when taken in conjunction with the accompanying drawings.

DESCRIPTION OF THE PREFERRED EMBODIMENT

Figures 1, 2, 4:
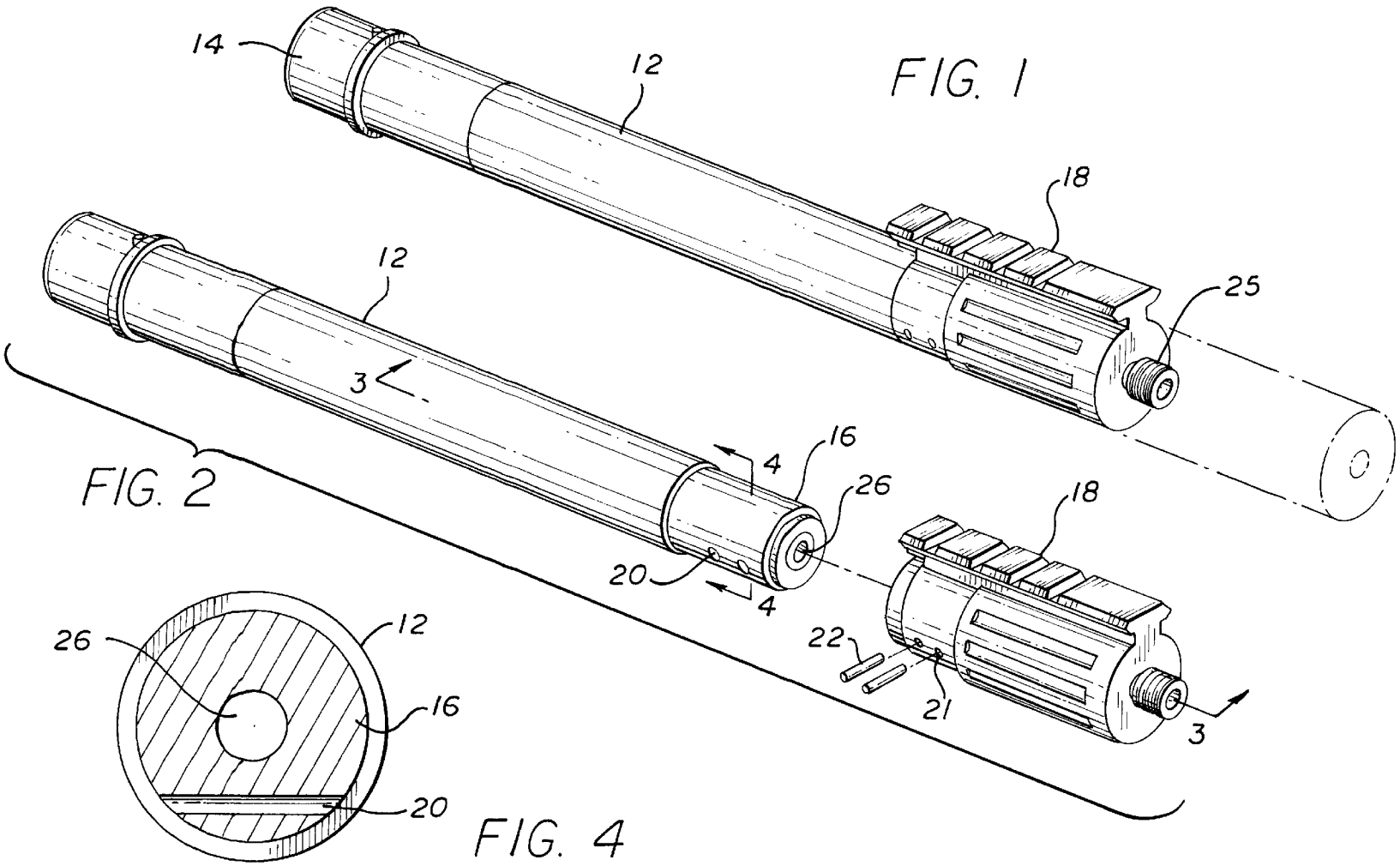
FIG. 1 is a view in perspective of the modified barrel which is the subject of the present invention.
FIG. 2 is an exploded view in perspective of the embodiment of FIG. 1.
FIG. 4 is a cross section taken along line 4—4 of FIG. 2.

Referring now to FIGS. 1 and 2, the modified barrel for a gas-operated automatic weapon made in accordance with the present invention is shown with a shortened M-16 barrel 12 having the standard configured end 14 for attachment to the receiver of the conventional M-16 weapon. The distal end 16 of the barrel is provided with a muzzle attachment 18. While the proximal end 14 is unchanged, the distal end 16 is reduced in diameter as shown in FIG. 2 for insertion into the adjacent end of attachment 18. When in position, as shown in FIG. 1, the transverse receiving holes 20 in distal end 16 are aligned with mating receiving holes 21 in the attachment. The securing of one part to the other to prevent relative movement therebetween is provided by engaging pins 22 which are driven in place as shown in FIG. 1. The exposed end of attachment 18 is provided with a threaded receiving member 25 which permits affixation of a typical suppressor or silencing device to the assemblage as shown by the dashed lines of FIG. 1.

Figure 3:
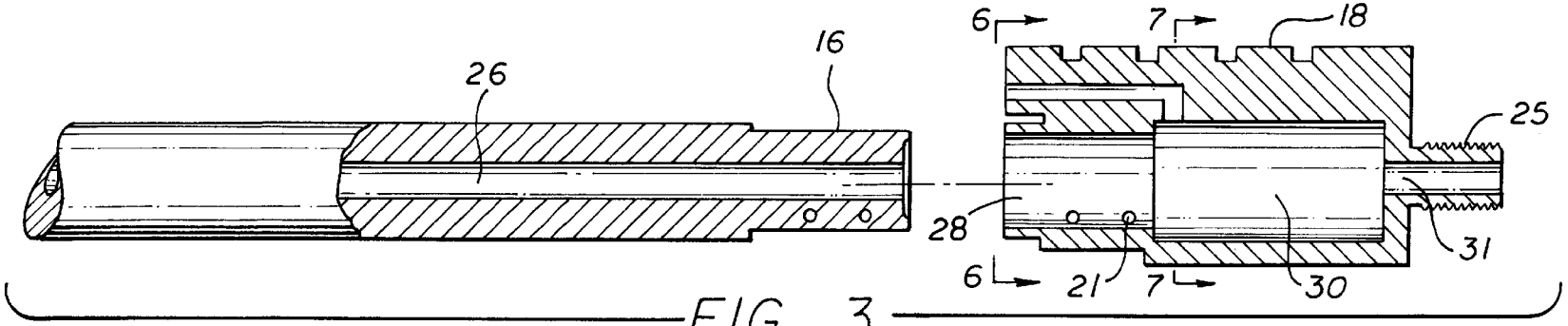
FIG. 3 is a cross sectional view taken along line 3—3 of FIG. 2.
Figure 5:
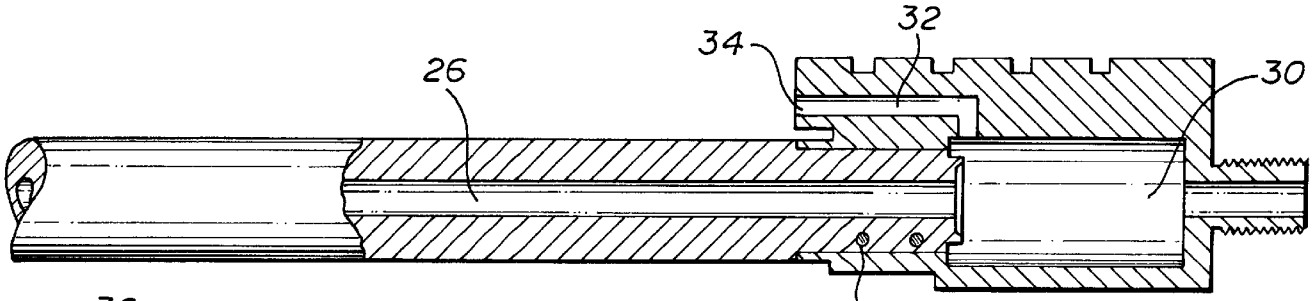
FIG. 5 is a partial cross section showing the muzzle attachment affixed to the barrel.

The constructional features of the invention are shown in FIGS. 3, 4 and 5 wherein the cross sectional views show the bore 26 extending along the longitudinal axis of barrel 12. The distal end 16 of the barrel has a region of reduced diameter containing transverse receiving holes 20 as seen in FIG. 4. The adjacently positioned attachment 18 is provided with recess 28 for receiving the distal portion of the barrel and includes mating receiving holes 21. Gas expansion chamber 30 is adjacently positioned the recess 28 and is of greater diameter. The central passage 31 is in alignment with bore 26 and provides the exit port for the round travelling through the barrel. When fully inserted and locked into position by engaging pins 22 the end of the barrel is shown with a chamfered edge which, when the distal end 16 is inserted into the attachment, extends slightly into gas expansion chamber 30. The provision of the chamfered edge is to facilitate insertion and does not directly effect the operation of the invention. Expansion chamber 30 is connected via conduit 32 to port 34. The port is located at the first end of the housing and is positioned to receive the piston of the mechanical linkage of the gas drive mechanism of the M-16 weapon. Since a significant advantage of the present invention is the ability to operate without redesign of existing mechanisms, the standard M-16 gas drive mechanism including the piston is not described in detail.

Figure 7:
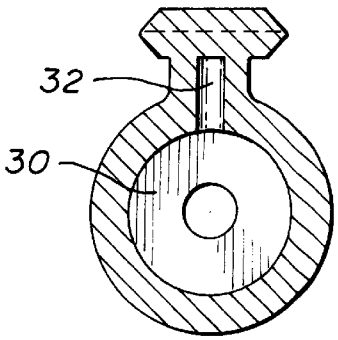
FIG. 7 is a cross sectional view taken along line 7—7 of FIG. 3.
Figure 6:
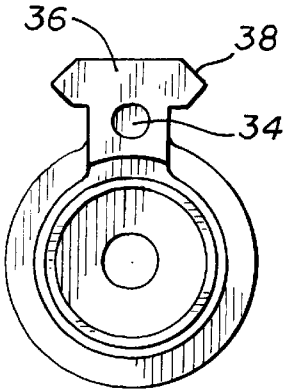
FIG. 6 is an end view taken along line 6—6 of FIG. 3.

The top portion of the attachment housing is provided with a rail 36 extending along its length. The configuration of the rail is shown in FIGS. 6 and 7 as having tapered edges 38 for slidably receiving telescopic sites or other fixtures thereon. As shown in FIG. 7, the conduit 32 extends upwardly toward the base of the rail from the gas chamber 30 and then turns to extend toward the receiver of the M-16 exiting at port 34. The entry to the conduit is in the wall of the expansion chamber and therefore spaced from the path of the round. Heretofore, the provision of the conduit in the bore results in the high pressure, high temperature gas stream producing non-uniformity in the adjacent surface of the bore thereby adversely impacting the performance of the weapon. The placement of the conduit entry in the expansion chamber wall eliminates changes around the bore from the exiting of the gas stream. Furthermore, the conduit makes an abrupt change in direction in the housing, shown as a right angle, to prevent a shock wave generated in the expansion chamber from directly impinging on the gas drive mechanism. The effect of an unanticipated shock wave in the gas expansion chamber would be dissipated in part by the abrupt change in direction. Thus, direct gas drive to a piston in alignment with conduit 32 is avoided.

In the embodiment shown, the standard M-16 barrel of 22 inches has been reduced to 9.5 inches. The firing of a round from the M-16 typically creates a chamber pressure in the range of 50,000 to 57,000 psi. The design for normal exit pressure of a 22 inch M-16 barrel is about 16,000 psi. The present invention delivers the anticipated pressure level to the output port 34 for use by the gas operated drive mechanism so that the weapon mechanisms do not experience any change in operating parameters as a result of the reduced barrel length. The compensation for the reduced bore volume of the shortened barrel is provided by the gas expansion chamber 30. In the embodiment tested and operated as shown, the diameter of the gas expansion chamber was three times the diameter of bore 26. The length of the gas expansion chamber is 1.5 inches. The diameter of the conduit 32 is 75% of that of bore 26. The path length to port 34 is approximately equal to the length of the expansion chamber.

In operation, the M-16 weapon containing the modified barrel of the present invention duplicated the cyclic rate of the conventional long barrel. The M-16 with the shortened barrel did not experience any high pressure damage as a result of excessive force on the gas drive mechanism and the firing rate was maintained essentially constant during operation. In addition, the muzzle attachment has been found to reduce the flash exiting the end of the barrel. Due to the high pressures in shortened barrels, it is typical that the weapon carrying a reduced length barrel provide a visually striking flash or flame. Prior attempts to provide automatic weapons with shortened barrels have resulted in flame exiting the barrel for a distance of up to four feet. In marked contrast, the present invention when utilized with the modified barrel of the M-16 weapon produces a six inch flame. The addition of a suppressor or a silencer to the free end of the attachment by means of the external threads provided has been found to further reduce the flame or flash exiting the weapon. A further advantage resulting from the use of the present invention is a cooling effect. As the gas rapidly expands in the chamber, the temperature is reduced and the weapon operates with a reduced material buildup in the gas drive mechanism and in the conduit 32. Thus, the modified barrel and muzzle attachment permit the reduction of barrel length without experiencing many of the problems associated with prior attempts to reduce barrel length in automatic weapons.

While the above description has referred to a specific embodiment of the invention, it is to be noted that many modifications and variations may be made therein without departing from the scope of the invention as claimed.

I claim:

1. A modified barrel for a gas-operated automatic weapon of the type utilizing the expansion of gas in the barrel to actuate a gas drive mechanism which comprises:

a) a barrel containing a bore with a longitudinal axis therein, said barrel having a distal end for receiving a muzzle attachment and a proximal end for affixation to a receiver of said automatic weapon;

b) a muzzle assembly for attachment to the distal end of the barrel, said assembly including:

i. a housing having first and second ends with a central passage extending therebetween, said central passage being aligned with the longitudinal axis of the bore;

ii. a sight rail located on said housing and aligned with said axis;

iii. an expansion chamber contained in said housing and communicating with the central passage;

iv. an external port located in the sight rail for connection to said gas drive mechanism;

v. a gas conduit formed in said housing and said sight rail, said conduit extending between the external port and the expansion chamber; and c) means for attaching the first end of the housing to the distal end of said barrel in sealing engagement therewith whereby an increase in gas pressure generated by the firing of the weapon is modified by the expansion chamber.

2. The modified barrel in accordance with claim 1 wherein said gas conduit contains an abrupt change in direction.

3. The modified barrel in accordance with claim 2 wherein said means for attaching the first end of the housing includes a recess having a first diameter formed in said first end of the housing for receiving the distal end of the barrel.

4. The modified barrel in accordance with claim 3 wherein the central passage of said housing extends through the expansion chamber, said expansion chamber having a diameter greater than said first diameter.

5. The modified barrel in accordance with claim 4 wherein said means for attaching further comprises a pair of traverse holes formed proximate to the distal end of the barrel and a mating pair of traverse holes formed in said housing, and engaging pins for placement in the mating pairs of traverse holes when aligned.

6. A muzzle attachment for the barrel of a gas-operated automatic weapon of the type utilizing the expansion of gas in the bore of the barrel to actuate a gas drive mechanism, said attachment modifying the characteristics of the gas generated in the barrel upon firing of the weapon to permit a reduction in length of the barrel, said attachment comprising:

a) a housing having first and second ends with a central passage therebetween, said first end including a recess for receiving the barrel therein, said passage being aligned with the bore of the barrel;

b) a sight rail formed on said housing;

c) an expansion chamber contained in said housing and communicating with the central passage;

d) an external port located in said sight rail for connection to said gas drive mechanism;

e) a gas conduit formed in said muzzle attachment and extending between the port and the expansion chamber, said gas conduit including an abrupt change in direction; and f) means for removably attaching the first end of the housing to the barrel in sealing engagement therewith whereby an increase in gas pressure generated by the firing of the weapon is modified by the expansion chamber.

7. The muzzle attachment of claim 6 wherein the second end of the housing is provided with means for removably receiving a second attachment device.

8. The muzzle attachment of claim 7 wherein the housing and the barrel are provided with mating receiving holes, and further comprising engaging pins for insertion into said receiving holes.

* * * * *